US005325691A

United States Patent [19]

Embry

[11] Patent Number: 5,325,691

[45] Date of Patent: Jul. 5, 1994

[54] METHOD AND APPARATUS FOR USE IN PICKING AND DECODING SIDEBAR LOCKS

[75] Inventor: Donald J. Embry, Cloverport, Ky.

[73] Assignee: HSL Marketing, Inc., Atlanta, Ga.

[21] Appl. No.: 6,260

[22] Filed: Jan. 19, 1993

[51] Int. Cl.[5] ..... E05B 19/20

[52] U.S. Cl. ..... 70/394; 33/540; 81/159

[58] Field of Search ..... 33/539, 540 X; 81/15.9 X, 488; 76/110; 70/394, 395, 368, 398, 399, 397, 495, 496

[56] References Cited

U.S. PATENT DOCUMENTS

| | | | |
|---|---|---|---|
| 1,991,151 | 2/1935 | Hansen | 76/110 |
| 2,338,768 | 1/1944 | Johnston | 70/394 |
| 2,720,032 | 10/1955 | Harwell | 70/394 |
| 2,791,840 | 5/1957 | Harwell | 33/540 |
| 3,735,496 | 5/1973 | Lee | 33/540 |
| 3,827,151 | 8/1974 | Naill . | |
| 4,185,482 | 1/1980 | Nail . | |
| 4,667,494 | 5/1987 | Joosten . | |
| 4,680,870 | 7/1987 | McConnell | 33/540 |

*Primary Examiner*—Peter M. Cuomo
*Assistant Examiner*—Darnell M. Boucher
*Attorney, Agent, or Firm*—Richard C. Litman

[57] ABSTRACT

The present invention relates to lock picking and decoding tools and a method of using the same. The lock decoding tools comprise a torquing tool, a picking tool, and decoding tools. The method comprises using the torquing tool to bias the locking bar out of a notch in the inner wall of the cylinder housing, picking the tumblers using the picking tool, turning the cylinder lock slightly so as to permit the torquing tool to be removed, turning the lock cylinder to the "ON" position, and decoding the cylinder lock using the decoding tools.

6 Claims, 7 Drawing Sheets

METHOD AND APPARATUS FOR USE IN PICKING AND DECODING SIDEBAR LOCKS

BACKGROUND OF THE INVENTION

1. Field of the Invention

The present invention relates generally to geometrical instruments and more specifically, to cylinder lock tumbler decoders and a method of using the same. The present invention also relates generally to locks and in particular, to picks keys for picking the operating elements of the operating mechanism of a lock.

2. Description of the Prior Art

For years locksmiths have spent an hour or longer trying to open or make an impression for a key in an ignition lock on the steering column of automobiles manufactured by General Motors of the United States. It has been said that these ignition locks cannot be picked and if the same could be picked, there is no way to decode the tumblers in the unlocked position. The present invention enables one skilled in the art of locksmithing to pick and decode ignition locks manufactured by General Motors of the United States.

Various types of tool sets and methods of decoding locks are known in the prior art. An example of such tool is found in U.S. Pat. No. 3,827,151 issued on Aug. 6, 1974 to Nail. This patent discloses a decoding instrument for a pin-type tumbler lock. The instrument includes a frame having a decoder support for a plurality of shim-like, toothed decoders, where the combined thickness of the support and decoders is less than the width of the key-receiving slot in the barrel of a lock. The decoders are shiftable independently of one another and longitudinally of the support to detect the individual movement of the pins. The frame includes indicia which, in combination with the movements of the decoders, can indicate the extent of movements of the pins that is necessary to release the barrel for movement relative to the lock-body.

In the Nail patent, decoding is effected by shifting the decoders separately. Each individual decoder is provided with a single tooth. The decoder support and the five decoders are inserted in the barrel through the slot of the lock. Then all levers are shifted to the right, at which position they will engage a screw and will register with the numeral 5. Then one of the levers is shifted to the left whereby the ramp on the tooth inserted the farthest moves the deepest pin upwardly. This movement is continued until resistance to further movement is encountered due to the fact that the deepest pin is being pushed by the tooth into engagement with the inner margin of the lock body. This is known as the condition of resistance to movement of the pin. This resistance can be felt by the operator and the operator is then aware that the pin is moved to the margin. The lever which was shifted to the left is maintained in that position and thereafter each of the other levers is shifted to the left individually until they each encounter resistance. When this process is completed, the instrument can now be turned. The decoder can then be withdrawn and a record is made of the positions of the levers with respect to the indicia (numerals) on the extension. Having the data, as indicated by the positions of the levers with respect to the indicia, the exact depths can be cut in a key blank.

An alternative lock decoding mechanism is found in U.S. Pat. No. 4,185,482 issued Jan. 29, 1980 to Nail. The Nail patent discusses the use of a mechanism for opening and/or decoding the biddings of a key for opening a cylinder lock employing wafer type tumblers. The Nail device can be used for opening such locks when a key is lost. The lock mechanism disclosed in the Nail patent has only five (5) wafer type tumblers whereas modern lock mechanisms as used in General Motors automobiles employ six (6) tumblers with a fixed spacing along the longitudinal axis of the lock mechanism, but only five (5) different tumbler positions.

U.S. Pat. No. 4,667,494 issued on May 26, 1987 to Joosten discusses the use of a tool set and a method of opening and decoding a side bar lock employing wafer type tumblers. In the Joosten patent, a spring compressor tool configured for insertion into the lock mechanism keyway raises all the tumblers to a radially outward position and compresses the springs that normally bias the tumblers inwardly. A spring retainer tool inserted into the keyway with the spring compressor tool engages the tumbler springs to retain the springs in a compressed position but frees the tumblers for movement. The tumbler adjusting tool is inserted to grasp the tumblers, and move the tumblers to a position where the lock mechanism can be opened. A decoding tool is inserted to measure the radial position of each tumbler and provide a number which can be used to make a new key. A dust cover holding tool is provided to hold open the spring actuated dust cover.

While the above mentioned devices are appropriate for their intended usage, none of the above inventions and patents, taken either singly or in combination, is seen to describe the instant invention as claimed.

SUMMARY OF THE INVENTION

The present invention relates to lock picking and decoding tools and a method of using the same. The lock decoding tools comprise a torquing tool for biasing the locking bar in engagement with tumblers, a picking tool for setting the tumblers such that the locking bar engages the V-notch of each individual tumbler, and decoding tools for determining the codes for the key cuts of each individual tumbler.

The torquing tool of the present invention comprises a handle having a segment of spring metal extending therefrom. The handle is purposed to manipulate the segment of spring metal between the lock cylinder and the cylinder housing. The spring metal is dimensioned and configured so as to be easily manipulated between the lock cylinder and the cylinder housing.

The picking tool includes a handle having an elongated member extending therefrom. The handle is provided to control the elongated member. The elongated member has an offset end engagable with the tumblers and a plurality of notches engagable with the entry of the key slot. The notches are arranged so as to meter the location of each individual and successive tumbler.

The lock decoding tools each include a decoding tool having a handle, and elongated member, and offset member or head. The lock decoding tools each provide means for gauging the position of the individual tumblers. In one embodiment, shims are used in cooperation with a decoding tool. The shims are each representative of the various key cuts which correspond to the various tumblers. In another embodiment, a decoding gauge is provided having markings indicative the varying codes representing the key cuts of the various tumblers. In yet another embodiment, a plurality of decoding tools are provided, each having a head dimensioned and configured so as to fit in the various gaps between the bottom of the key slot and the bottom of each of the tumblers. Each head is representative of a respective one of the various key cuts corresponding to the various respective tumblers.

The spirit of this invention lies not only in the unique lock decoding tools but also encompasses a distinctive method of decoding locks. The method comprises leveraging the locking bar out of a notch in the inner wall of the cylinder housing. This is accomplished through the use of the torquing tool. With the locking bar biased out of the notch, the lock is picked using the picking tool in the manner prescribed above. In the course of picking the lock, the V-notch in each of the tumblers is engaged by the locking bar. Next, the cylinder is permitted to turn slightly. The torquing tool may now be removed. The lock cylinder may at this point be turned to the "ON" position. In the "ON" position, the lock may be decoded using any one of the aforementioned decoding gauges and decoding tools.

It is accordingly a principle object of the present invention to provide a method of picking and decoding locks which in the past, due to the location of the locking bar and its relation to the cylinder housing, have been difficult to decode.

Accordingly, it is another principal object to provide a torquing tool which may be manipulated between the lock cylinder and the cylinder housing to access the locking bar and bias the locking bar out of the notch in the inner wall of the cylinder housing and toward the tumblers.

It is another object to furnish a picking tool capable of reaching the innermost tumbler of the lock cylinder and having a means to successively meter the engagement of the picking end of the picking tool with each individual tumbler.

It is a further object that lock decoding tools offer means to quickly and easily pick and decode a lock cylinder with a high standard of accuracy.

Still another object that a decoding tool used in conjunction with a decoding gauge which provides a visual indication of the various tumbler settings.

It is an object of the invention to provide improved elements and arrangements thereof in an apparatus for the purpose described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
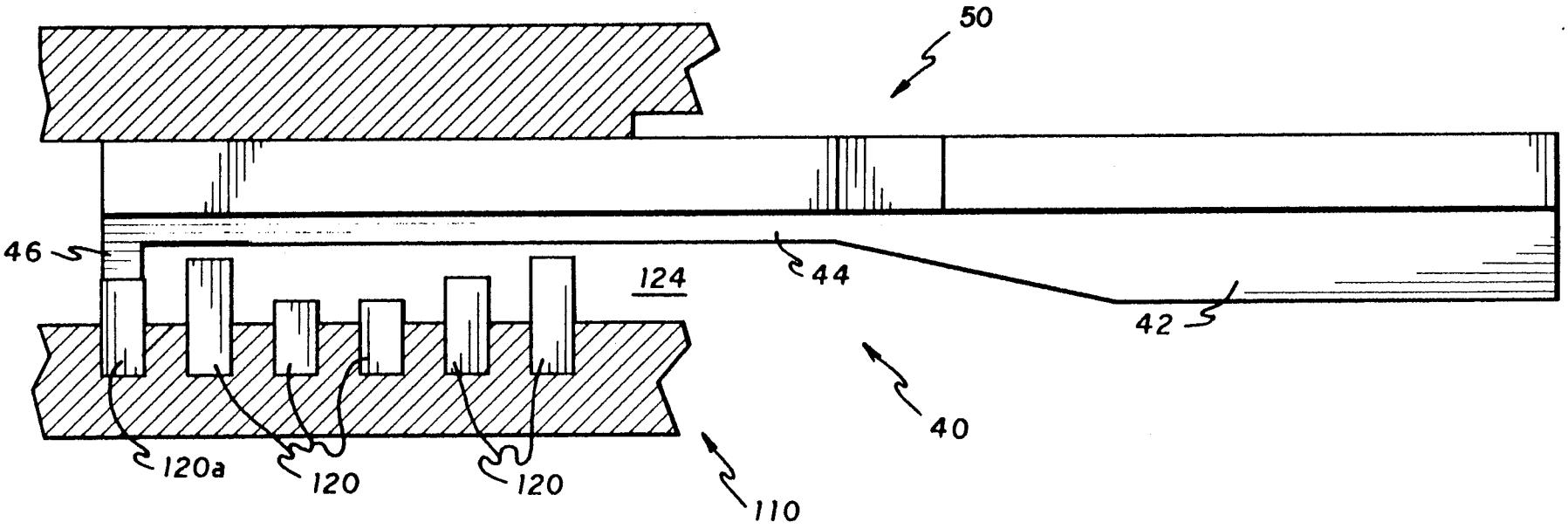
FIG. 1 is an environmental side elevational view of a decoding tool and a decoding shim in accordance with the present invention.

The present invention relates to lock decoding tools and a method of using the same. Method comprises two basic steps, picking the lock cylinder 110 and decoding the lock cylinder 110. The lock cylinder 110 is picked by first biasing the locking bar 130 toward the tumblers 120 and out of the notch 142 in the inner wall of the cylinder housing 140. This is accomplished through the application of a torquing tool 10*a*. With the torquing tool 10*a* applied, the lock cylinder 110 is picked. In picking a lock cylinder 110, each one of the tumblers 120 is set, meaning each individual tumbler 120 is manipulated independently until its respective V-notch 126 is fully engaged by the locking bar 130. This manipulation is achieved using a picking tool 30. Once the lock cylinder lock 110 has been correctly picked and turned slightly, the torquing tool removed, and cylinder turned to the unlocked or "ON" position, the cylinder lock is decoded through the aid of tumbler decoding tools 40,60,90 which gauge the height of each successive tumbler 120 separately. The height of each tumbler 120 determines the corresponding cut of the key (not shown). A myriad of tumbler decoding tools may be appreciated and the scope of the present invention is not limited to the decoding tools 40,60,90 shown in the drawings and hereinafter referred to in the specification.

Figure 2:
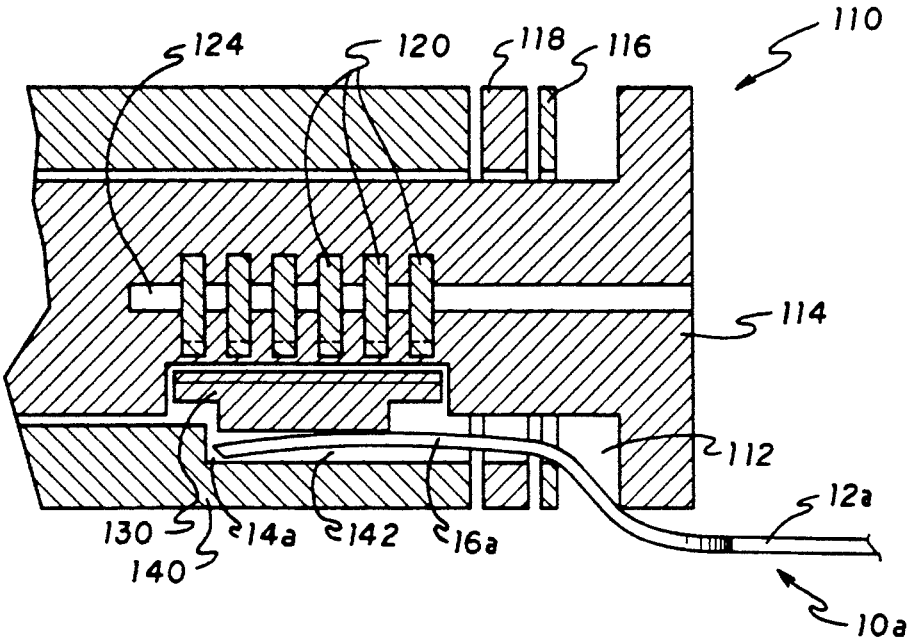
FIG. 2 is an environmental top plan of a torquing tool.
Figure 3A:
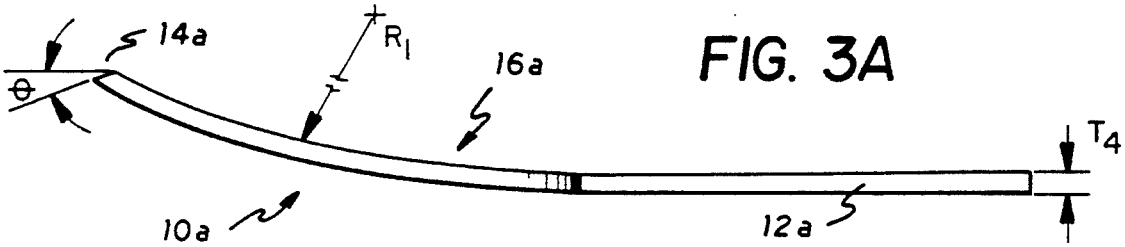
FIG. 3A is a side elevational view of the torquing tool shown in FIG. 2.
Figure 3B:
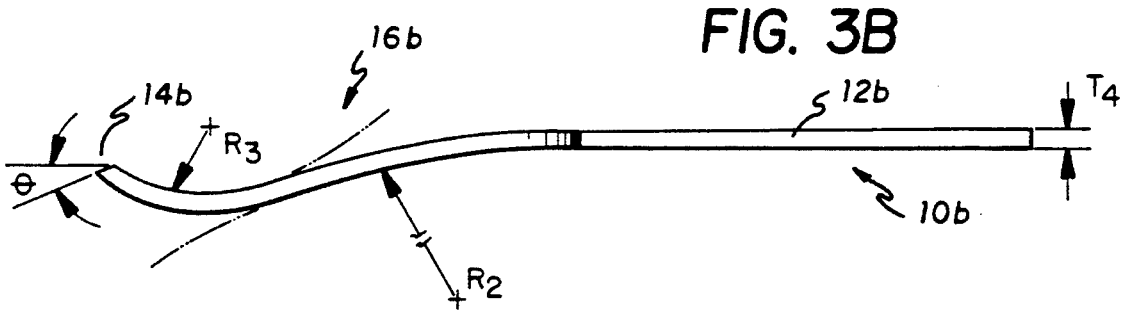
FIG. 3B is a side elevational view of an alternative torquing tool.
Figure 3C:
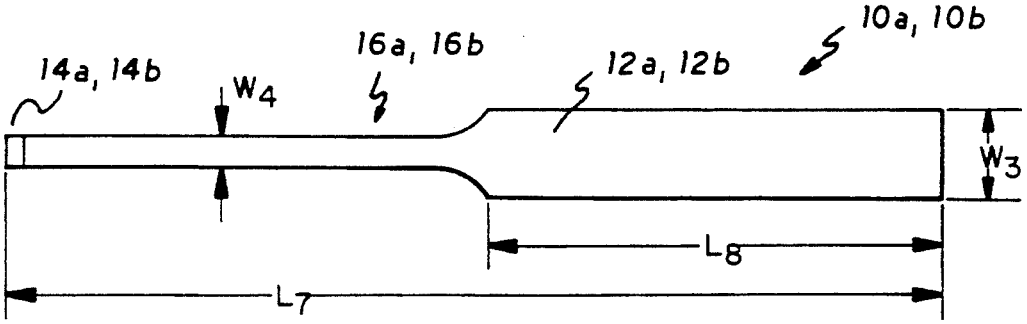
FIG. 3C is a plan view of the torquing tool shown in FIG. 3B.
Figure 13:
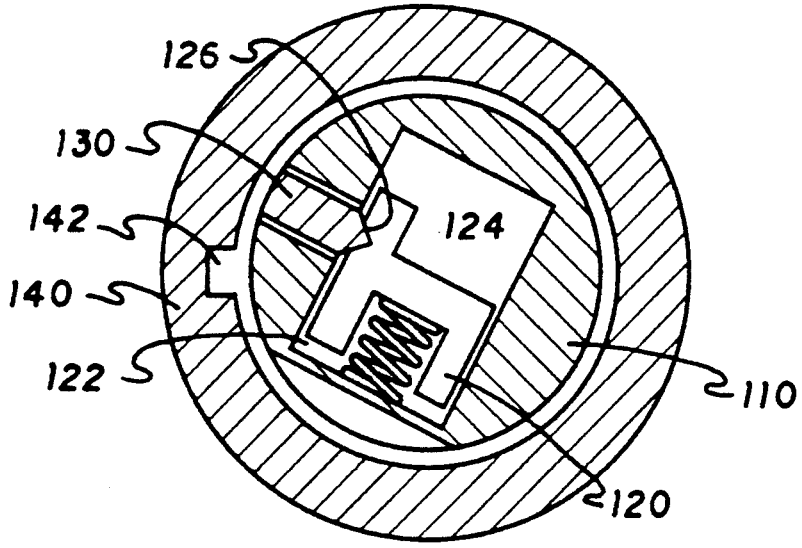
FIG. 13 is a front cross-sectional view of the lock cylinder shown in FIGS. 1,4,7, and 12.

Referring to the drawings and in particular, to FIGS. 2 and 3: showing the torquing tool 10*a* which enables torque to be applied to the locking bar 130 which, in the past, was unable to be biased. The torquing tool 10*a*, as shown in FIG. 2, inserted between the lock cylinder 110 and the lock cylinder housing 140 so as to rest against the locking bar 130. This is executed by directing the torquing tool 10*a* into the annular cavity 112 bounded between the forward most end portion 114 of the lock cylinder 110 and the cylinder housing 140, by guiding the torquing tool 10*a* under the first and second washers 116,118 and against the lock cylinder 110, and by further maneuvering the torquing tool 10*a* into the notch 142 that the locking bar 130 occupies prior to turning the lock cylinder 110 to the unlocked position as shown in FIG. 13. The torquing tool 10*a*, shown in FIG. 3, is dimensioned and configured so as to leverage against the inner wall of the cylinder housing 140 applying a biasing force against the locking bar 130 thus maintaining pressure between the locking bar 130 and the tumblers 120. The torquing tool 10*a* includes a handle 12*a* and a curved end segment 16*a*. The curvature of the curved end segment 16*a* enables the torquing tool 10*a* to be passed between the lock cylinder 110 and the cylinder housing 140 and to apply the constant leverage needed to bias the locking bar 130 against the tumblers 120. The curved end 16*a* has a continuous radius $R_1$ of 9/16 inch. An alternative torquing tool 10*b* has a serpentine or S-shaped curved end 16*b* having a first radius $R_3$ of 3/32 inch adjacent the beveled tip 14*b* thereof and a second radius $R_2$ of 15/16 inch abutting and continuous with the first radius $R_3$. Both torquing tools 10*a*,10*b* preferably have an overall length $L_7$ of $2\frac{3}{8}$ inch with a handle 12*a*, 12*b* extending the length $L_8$ of $1\frac{1}{4}$ inch. The width $W_3$ of the handle 19 is preferably 3/16 inch and the width $W_4$ of each end 16*a*,16*b* is preferably $0.070 \pm 0.002$ inch. The tip 14*a*,14*b* of each torquing tool 10*a*,10*b* is beveled at an angle $\theta$ 10 to 15 degrees below the horizontal. The torquing tools 10*a*,10*b* are made of spring metal preferably having a thickness of 0.015 inch.

Figure 4:
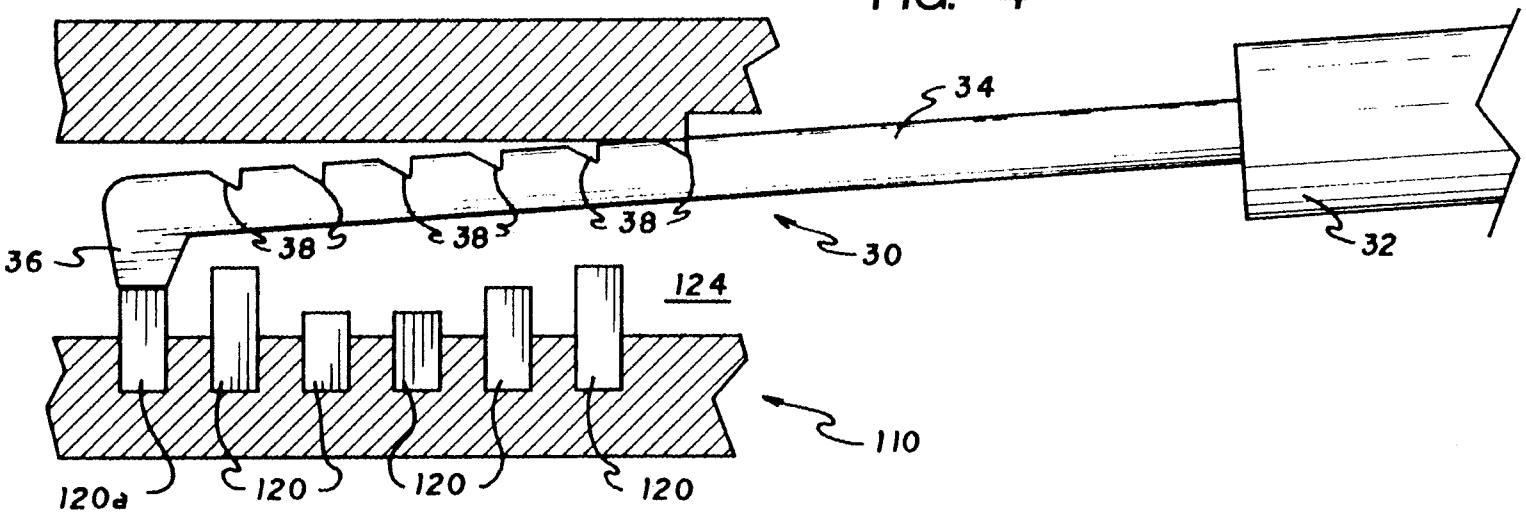
FIG. 4 is an environmental side elevational view of a picking device.

After having introduced the torquing tool 10*a* in the proper manner,, the lock cylinder 110 is picked. FIG. 4 shows a picking device 30 comprising a handle 32 and an elongated member 34 extending from the handle 32. The distal end of the elongated member 34 includes an offset tip or a picking end 36. The picking end 36 is dimensioned and configured so as to properly fit in each of the bores in which the tumblers 120 reside. The height from the bottom of the elongated member 34 to the top of the picking end 36 is preferably 0.145 inch which is equivalent to a No. 5 key cut on an ignition key matingly engagable with an ignition switch in automobiles manufactured by General Motors Corporation of the United States. When inserted into the key slot 124, the notches 38 along the intermediate portion of the bottom edge of the elongated member 34 successively engage the top surface opening of the key slot 124. Beginning with the pick device 30 fully inserted into the key slot 124, the handle 32 is pivoted upward pivoting the picking end 36 downward. As the picking device 30 is slid out of the key slot 124, each notch 38 will successively engage the top surface of the opening of the key slot 124 and the picking end 36 will respectively engage a corresponding No. 5 tumbler 120 and position each tumbler 120 in a picked posture. In the picked posture, the V-notch 126 (see FIGS. 12 and 13) of each tumbler 120 will fully engaged the locking bar 130.

Figure 5B:
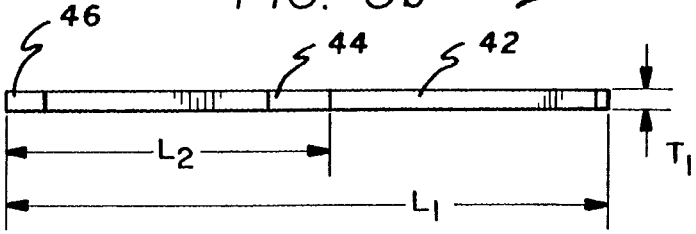
FIG. 5*b* is a top plan of the decoding tool shown in FIG. 1.
Figure 5A:
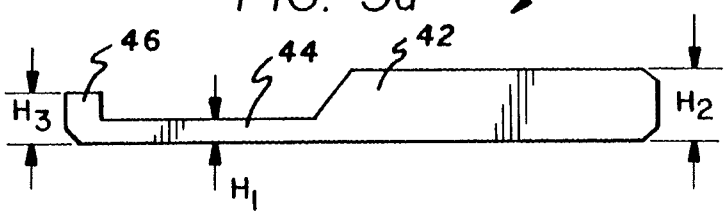
FIG. 5*a* is a side elevational view of the decoding tool shown in FIG. 1.
Figure 6B:
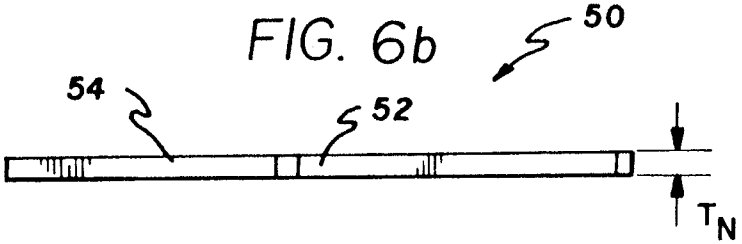
FIG. 6*b* is a side elevational view of the decoding shim shown in FIG. 1.
Figure 6A:
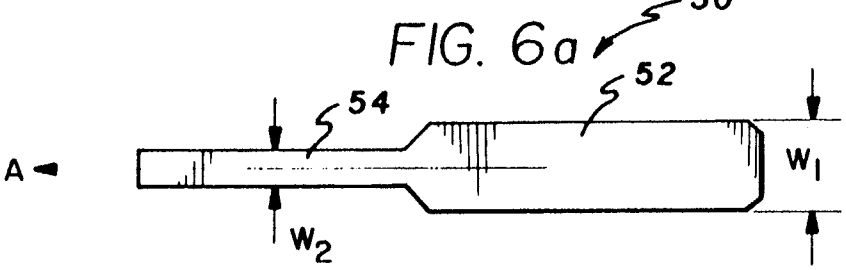
FIG. 6*a* is a top plan of the decoding shim shown in FIG. 1.

Once the tumblers 120 are picked or set, that is, once the locking bar 130 engages the V-notch 126 of each tumbler 120 (shown in FIG. 13), the lock cylinder 110 is turned partially (see FIG. 13) to enable the torquing tool 10*a* to be removed without disturbing the position of the locking bar 130 relative to the tumblers 120. With the torquing tool 10*a* removed, the lock cylinder 110 may be turned entirely to the unlocked or "ON" position. Now, the lock cylinder 110 may be decoded. FIGS. 1,5 and 6 show a decoding tool 40 used in conjunction with a decoding shim 50 which cooperatively decodes the lock cylinder 110.

FIG. 1 shows the decoding tool 40 including a handle 42, an elongated member 44, and an offset end 46. The elongated member 44 extends from the bottom edge of the handle 42 establishing a coplanar relationship between the bottom edge of the handle 42 and the bottom edge of the elongated member 44. Disposed at the distal end of the elongated member 44 is the offset end 46. The bottom edge of the elongated member 44 is also coplanar with the bottom edge of the offset end 46. The decoding tool 40 preferably has an overall length $L_1$ of 3.000 inches. The elongated member 44 preferably has a length $L_2$ of 1,250 inch so as to extend the offset end 46 into the key slot 124 to engage the innermost tumbler 120*a*. The elongated member 44 has a height $H_1$ which significantly varies from the height $H_2$ of the handle 42 to enable the handle 42 to offer optimum control of the decoding tool 40. The height $H_1$ of the elongated member 44 is preferably 0.045 inch. The height $H_3$ of the offset end 46 is preferably 0.145 inch which is equivalent to a No. 5 key cut. The thickness $T_1$ of the decoding tool, as shown in FIG. 5, is preferably 0.030 inch so as to fit into the key slot 124.

Similar to the decoding tool 40, the decoding shim 50 is shown in FIG. 6 to include a handle 52 and an elongated member 54 extending from the distal end of the handle 52. The handle 52 and the elongated member 54 share a common axis A. The width $W_1$ of the handle 52 is preferably 0.250 inch to provide optimum control of the decoding shim 50 and the width $W_2$ of the elongated member 54 is preferably 0.030 inch so as to fit in the key slot 124. The decoding shim 50 is fabricated in varying thicknesses $T_N$. These thicknesses $T_N$ preferably range as follows: 0.022 inch; 0.048 inch; 0.072 inch; and 0.097 inch. The thicknesses $T_1$,$T_N$ of the decoding tool 40 and the various decoding shims 50 combined provide a representation of the various codes for the corresponding key cuts.

Referring back to FIG. 1, the decoding tool 40 is inserted in an upright manner into the key slot 124 so the offset end 46 is directed downward to engage the innermost tumbler 120*a*. The various decoding shims 50 are inserted above and perpendicular to the decoding tool 40. The decoding shims 50 are inserted into the key slot 124 one at a time starting with the thickest one (0.097 inch) first, descending to the next thickest (0.072 inch), and then the next thickest (0.048 inch), and finally the next thickest (0.022 inch) until one of the decoding shims 50 fits snug in the key slot 124. The thickest decoding shim 50 which fits in the key slot 124 along with the decoding tool 40 provides a code for a corresponding key cut. After determining the code for the innermost tumbler 120*a*, the codes for the succeeding tumblers 120 are determined in a like manner.

Figure 7:
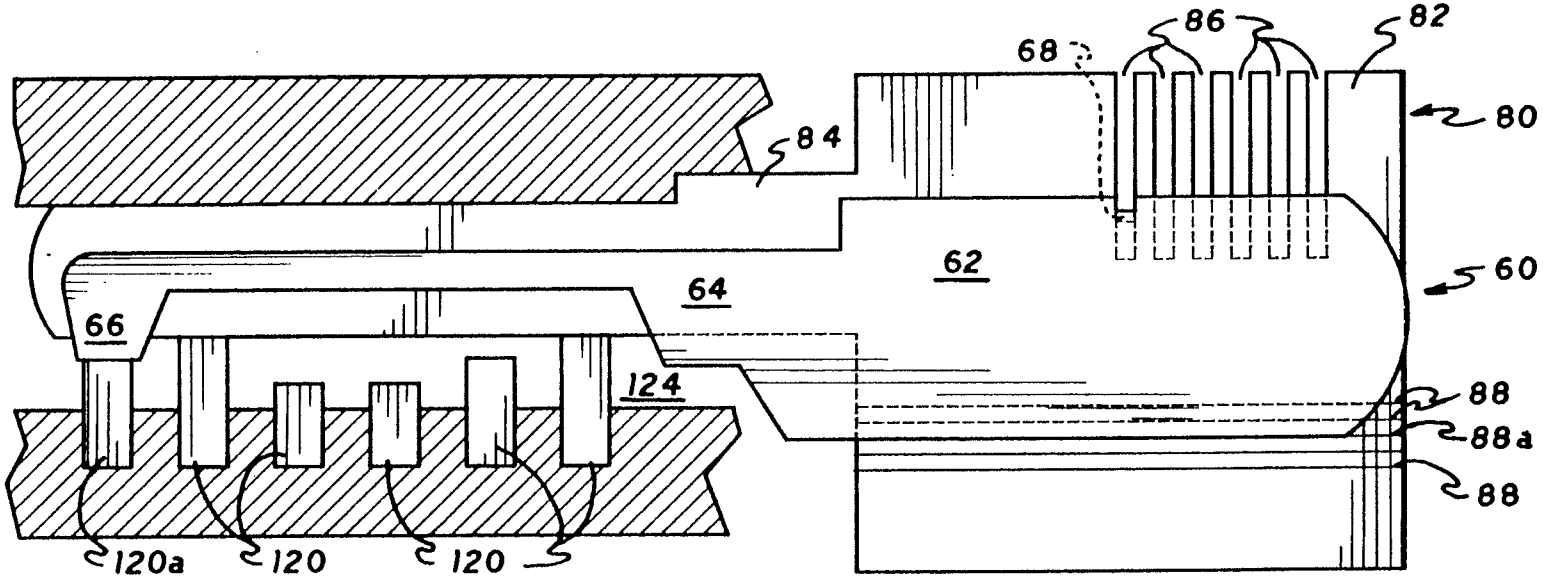
FIG. 7 is an environmental side elevational view of an alternative decoding tool and decoding gauge.
Figure 8A:
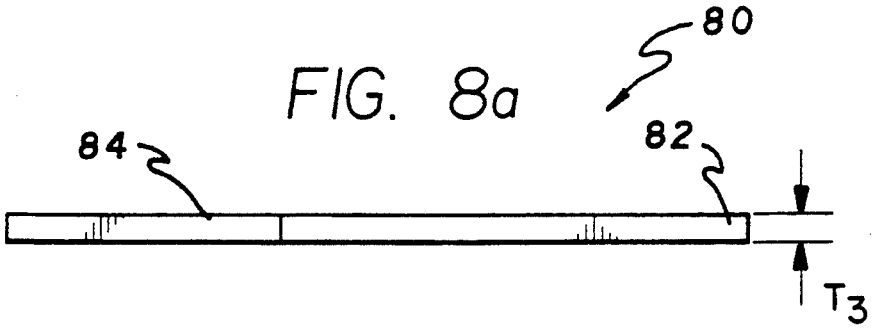
FIG. 8*a* is a top plan of the decoding gauge shown in FIG. 7.
Figure 8B:
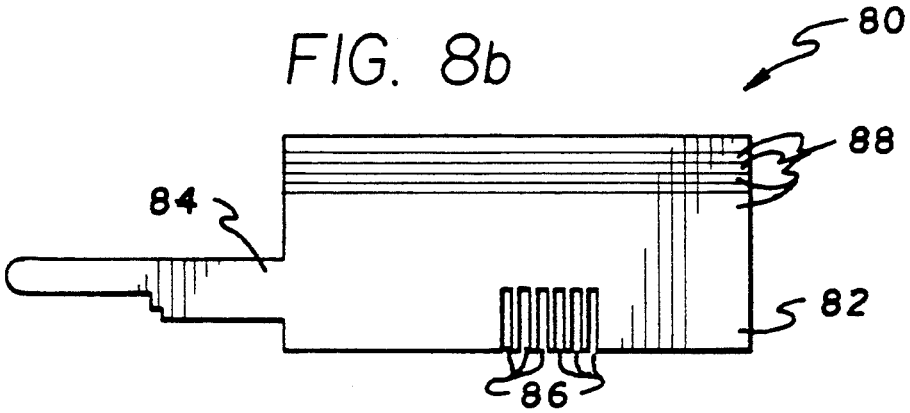
FIG. 8*b* is a side elevational view of the decoding gauge shown in FIG. 7.
Figure 9A:
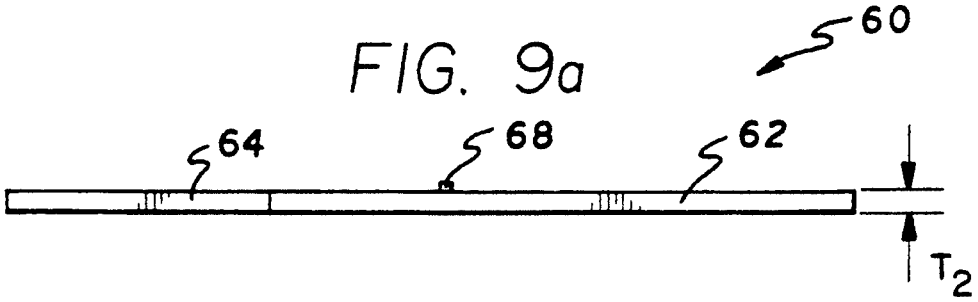
FIG. 9*a* is a top plan of the decoding tool shown in FIG. 7.
Figure 9B:
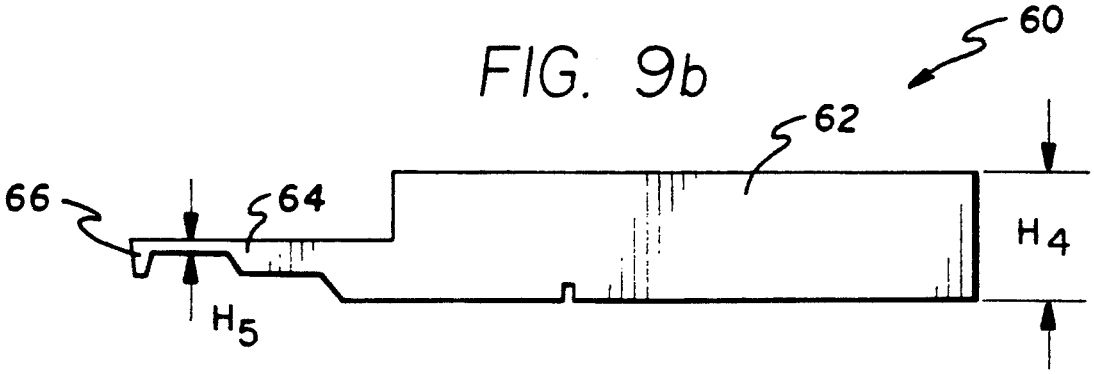
FIG. 9*b* is a side elevational view of the decoding tool shown in FIG. 7.

An alternative decoding tool 60 and a decoding gauge 90 for use in cooperation with the decoding tool 60 is shown in FIGS. 7 through 9. The decoding tool 60 is shown to include a handle 62, an elongated member 64 extending from the handle 62, and an offset end 66 located at the distal end of the elongated member 64. The decoding tool 60 is substantially planar, as shown in FIGS. 9*a* and 9*b*, preferably being fabricated of spring metal having a thickness $T_2$ of 0.015 inch. The handle 62 is provided with two slight incisions and the material between the two incisions is folded at a right angle relative to the handle 62 so as to form a tongue 68 having an orientation perpendicular to the handle 62. The elongated member 64 has a height of $H_4$ which is significantly less than that of the height $H_5$ of the handle 62. The distal end of the handle 62 from which the elongated member 64 extends is configured so as to conform with the entry or opening of the key slot 124. The offset member 66 is configured to fit within the bores in which the tumblers 120 reside.

As with the decoding tool 60, the decoding gauge 80 includes a handle 82 having an elongated member 84 extending from the distal end thereof. Like the decoding tool 60, the decoding gauge 80 is preferably fabricated of resilient metal having a thickness $T_3$ of 0.015 inch. The handle 82 is substantially rectangular in shape having a top edge and a bottom edge. The top edge has a plurality of slots 86 therein, each slot 86 being disposed parallel to the distal end and perpendicular to the top edge. The bottom portion of the handle 82 carries incremental or graduating marks 88 which correspond to varying codes representative of various key cuts. The decoding tool 60 and the decoding Gauge 80 are arranged parallel and juxtapose to one another such that the tongue 68 of the decoding tool 60 first engages the slot 86 corresponding to the innermost tumbler 120*a*. Both the decoding tool 60 and the decoding gauge 80 are insertable into the key slot 124 so as to engage the offset end 66 and the innermost tumbler 120*a*. Now, the decoding tool 60 is slid against the decoding gauge 80 in a direction downward until the offset end 66 contacts the innermost tumbler 120*a*. When the offset end 66 contacts the innermost tumbler 120*a*, the handle 62 of the decoding tool 60 will align with a graduation mark 88*a* on the handle 82 of the decoding gauge. This graduation mark 88*a* corresponds to the code for the key cut of the innermost tumbler 120*a*. Once the code for the key cut of the innermost tumbler 120*a* is determined, tongue 68 is engaged in the next successive slot 86 to determine the next code. This process is repeated until all of the codes are determined.

Figure 10:
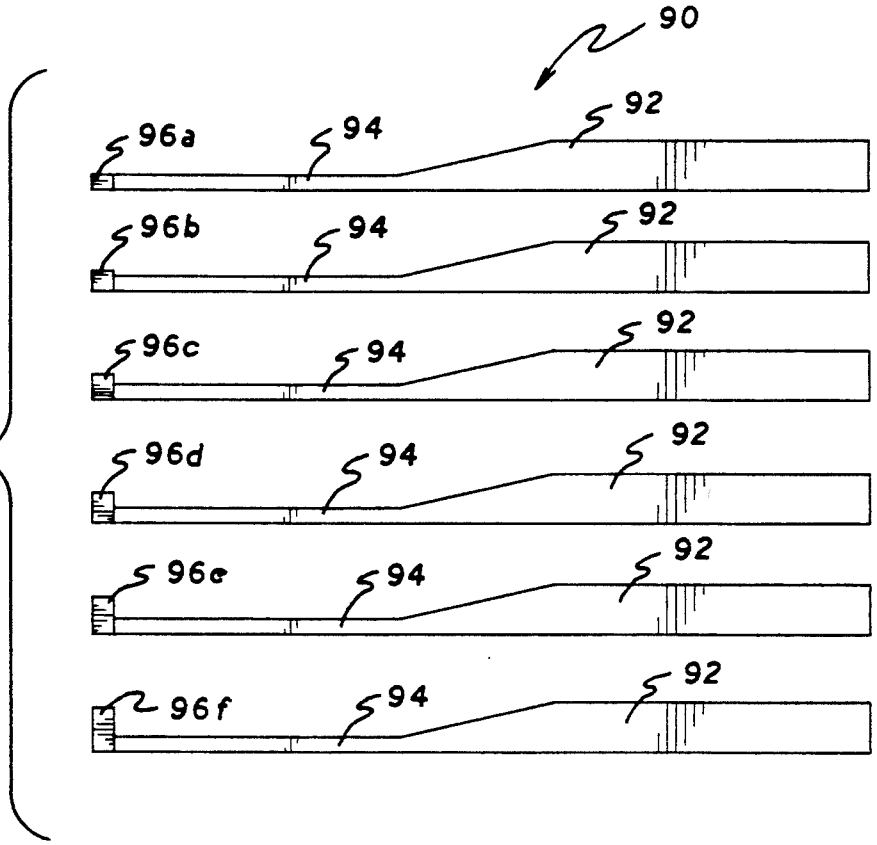
FIG. 10 is a side elevational view of alternative decoding tools.
Figure 11:
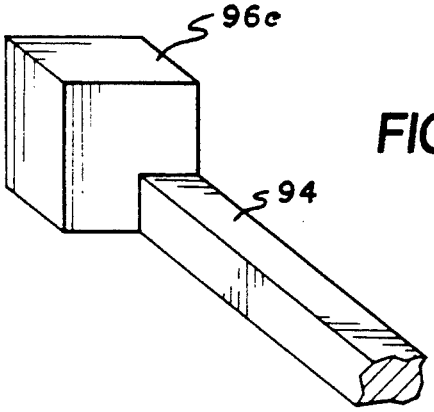
FIG. 11 is a perspective view of the head of an alternative decoding tool shown in FIG. 10.
Figure 12:
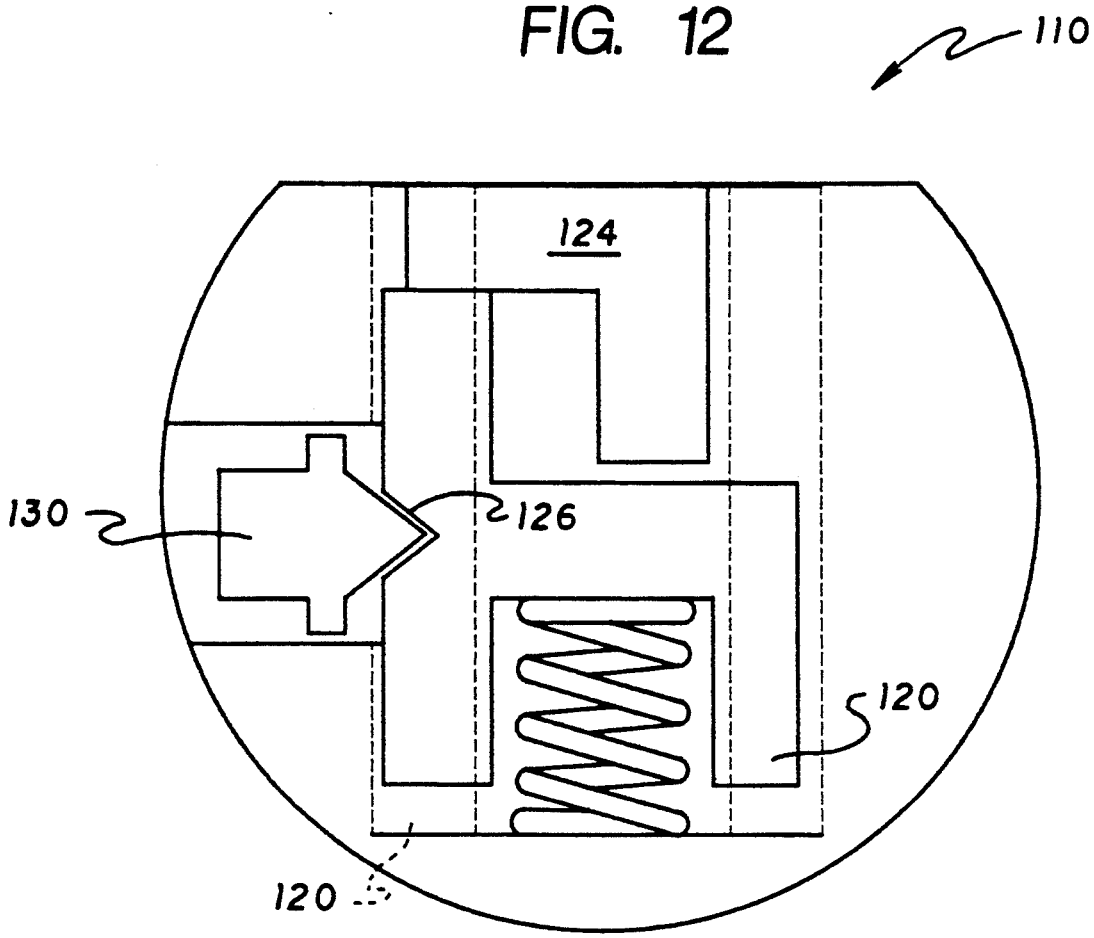
FIG. 12 is an environmental front elevational view of an alternative decoding tool shown in FIG. 10.

Yet another set of decoding tools 90 are shown in FIGS. 10 through 12. These decoding tools 90 each include a handle 92 having an elongated member 94 extending therefrom. These decoding tools 90 each include a head 96*a*–96*f*. Each head 96*a* through 96*f* varies in size to correspond to a respective key cut. The decoding tools 90 are each independently and successively insertable into the key slot 124 beginning with the largest head 96*f* first and descending to the smallest head 96*a*. As shown in FIG. 12, the decoding tools 90 are each slid along the top of the key slot 124 and against the left side of the key slot 124 feeling for the bores 122 in which the tumblers 120 occupy. Check all six bores 122 to see if the largest head 96*f* fits between the bottom of the bore 122 and the bottom of the tumbler 120. If the largest head 96*f* fits in any one of the six bores 122, make a record indicating so. Each successively smaller head 96*e*–96*a* is inserted into the key slot 124 and the process is repeated until the gap between each bore 122 and each respective tumbler 120 has had fitted therein a corresponding head 96*f*–96*a* one of the plurality of decoding tools 90.

It is to be understood that the present invention is not limited to the embodiments described above, but encompasses any and all embodiments within the scope of the following claims.

I claim:

1. A lock picking and decoding apparatus for decoding a sidebar cylinder lock, the cylinder lock including a cylinder housing having means defining a notch in an interior wall thereof; a lock cylinder having a plurality of bores and a plurality of tumblers disposed within a respective one of the plurality of bores, each one of the plurality of tumblers further having means defining a V-notch therein; means defining a key slot having an opening, a top surface, and a right side; and a locking bar engagable with both the notch and the tumblers, said lock decoding apparatus comprising:

a torquing tool, including a handle with an elongated strip on spring metal extending therefrom, said torquing tool being dimensioned and configured so as to be passed between the lock cylinder and the cylinder housing and to apply a biasing force against the locking bar to bias the locking bar out of the notch in the interior wall of the cylinder housing and to bias the locking bar against the tumblers, a picking device comprising a handle having an elongated member extending therefrom, said elongated member having a picking end and being dimensioned and configured so as to fit in the key slot and engage said picking end and each one of the plurality of tumblers, said picking device further comprising a plurality of notches disposed equidistantly apart along said elongated member, wherein when said picking device is inserted into the key slot, each one of said plurality of notches successively engage the opening of the key slot and with the engagement of each one a said plurality of notches with the opening of the key slot, said picking end is engagable with a respective one of the plurality of tumblers to pick the respective one of the plurality of tumblers, a decoding tool including a handle having an elongated element extending therefrom, said elongated element having an offset end and being dimensioned and configured so as to fit into the key slot and extend said offset end into the key slot to engage an innermost one of the plurality of tumblers, means for gauging a position of the tumbler, the position of the tumbler corresponding to a code for making a key cut, whereby said decoding tool is insertable into the key slot to engage one of the plurality of tumblers and said means for gauging the position of the tumbler provides an indication of the code for making a key cut.

2. The apparatus according to claim 1, wherein said means for gauging a position of the tumbler comprises a decoding shim including a handle having an elongated segment extending therefrom, said elongated segment having a width so as to fit in the key slot, said decoding shim being of a predetermined thickness, whereby said decoding tool and said decoding shim are insertable into the key slot so as to fit tightly between the tumbler and the top surface of the key slot, said decoding shim representing a code corresponding to a key cut.

3. The apparatus according to claim 2, further including a plurality of decoding shims, each one of said plurality of decoding shims representing one of a plurality of codes corresponding to one of a plurality of key cuts.

4. The apparatus according to claim 1, wherein said decoding tool is substantially planar having a tongue oriented perpendicular to said handle, and wherein means for gauging a position of the tumbler comprises a decoding gauge for use in cooperation with said decoding tool, said decoding tool having a handle and an elongated extension extending therefrom, said handle of said decoding gauge being is substantially planar and having a plurality of slots therein, each one of said plurality of slots corresponding to one of the plurality of tumblers, said handle of said decoding gauge further carrying a plurality of graduating marks, each one of said plurality of graduation marks corresponding to one of a plurality of codes representative of one of a plurality of key cuts, whereby said decoding tool and said decoding gauge are arranged parallel and juxtapose to one another such that said tongue of said decoding tool engages a one of said plurality of slots, both said decoding tool and said decoding gauge are inserted into the key slot so as to engage said offset end of said decoding tool and a respective one of the plurality of tumblers corresponding to said one of said plurality of slots, and said handle of said decoding tool aligns with a one of said plurality of graduation marks corresponding to one of the plurality of codes representative of one of the plurality of key cuts.

5. The apparatus according to claim 1, wherein said means for gauging a position of the tumbler comprises a head located at an end of said elongated element, said head having a predetermined dimension and being insertable into the key slot along a top surface thereof and against the left side thereof so as to feel for the plurality of bores, whereby if said head fully occupies a gap between a one of the plurality of tumblers and the top surface of the key slot, said dimension of said head provides a representation of a code corresponding to a key cut.

6. The apparatus according to claim 1, further including a plurality of decoding tools, said head of each one of said plurality of decoding tools being of a different predetermined dimension, whereby each one of said plurality of decoding tools corresponds to one of a plurality of codes representative of one of a plurality of key cuts.

* * * * *